US009531115B2

(12) United States Patent
Ebihara

(10) Patent No.: US 9,531,115 B2
(45) Date of Patent: Dec. 27, 2016

(54) DEW CONDENSATION PROOF CONNECTOR

(71) Applicant: Japan Aviation Electronics Industry, Ltd., Tokyo (JP)

(72) Inventor: Hiroyuki Ebihara, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/856,855

(22) Filed: Sep. 17, 2015

(65) Prior Publication Data

US 2016/0126663 A1 May 5, 2016

(30) Foreign Application Priority Data

Oct. 29, 2014 (JP) ..... 2014-219888

(51) Int. Cl.

| | |
|---|---|
| ***H01R 4/60*** | (2006.01) |
| ***H01R 4/62*** | (2006.01) |
| ***H01R 13/52*** | (2006.01) |
| *H01R 13/74* | (2006.01) |

(52) U.S. Cl.

CPC ..... *H01R 13/5227* (2013.01); *H01R 13/748* (2013.01)

(58) Field of Classification Search

CPC .... H01R 13/5227; H01R 13/748; H01R 13/52
USPC ..... 439/190
See application file for complete search history.

(56) References Cited

U.S. PATENT DOCUMENTS

| | | | | |
|---|---|---|---|---|
| 4,553,807 | A * | 11/1985 | Cane | H01R 13/533 439/190 |
| 5,769,660 | A | 6/1998 | Sakurai et al. | |
| 2008/0268706 | A1 | 10/2008 | Sheng | |
| 2014/0065861 | A1 | 3/2014 | Mizutani et al. | |

FOREIGN PATENT DOCUMENTS

| | | | |
|---|---|---|---|
| EP | 2056412 | A2 | 5/2009 |
| EP | 2706618 | A2 | 3/2014 |
| FR | 2844106 | A1 | 3/2004 |
| JP | 2001-118628 | A | 4/2001 |

(Continued)

OTHER PUBLICATIONS

Machine translation of FR 2844106.*

(Continued)

*Primary Examiner* — Javaid Nasri
(74) *Attorney, Agent, or Firm* — Maier & Maier, PLLC

(57) ABSTRACT

A receptacle is a connector that is attached to a casing and allows electric wires within the casing to be attached to the connector and includes a receptacle shell. The receptacle shell includes a rectangular tubular portion projecting toward an inside of the casing and covering the electric wires within the casing. The rectangular tubular portion has four outer surfaces respectively provided with drain grooves that are made of metal formed by casting and are continuous with each other. A cross-section of each drain groove has an asymmetrical shape in which a deepest portion of each drain groove is farther from a tip of the rectangular tubular portion than a groove width center of each drain groove. The deepest portion is raised at a center of each drain groove in a longitudinal direction so that a water droplet within each drain groove moves toward ends of each drain groove.

4 Claims, 10 Drawing Sheets

(56) References Cited

FOREIGN PATENT DOCUMENTS

| | | | |
|---|---|---|---|
| JP | 2009-110754 | A | 5/2009 |
| JP | 2013-045567 | A | 3/2013 |

OTHER PUBLICATIONS

Extended European Search Report dated Jan. 22, 2016, in connection with corresponding EP Application No. 15187142.3 (9 pgs.).

* cited by examiner

RELATED ART

DEW CONDENSATION PROOF CONNECTOR

INCORPORATION BY REFERENCE

This application is based upon and claims the benefit of priority from Japanese patent application No. 2014-219888, filed on Oct. 29, 2014, the disclosure of which is incorporated herein in its entirety by reference.

BACKGROUND OF THE INVENTION

1. Field of the Invention

The present invention relates to a connector.

2. Description of Related Art

Japanese Unexamined Patent Application Publication No. 2009-110754 discloses an electrical connector 100 which is attached to an airtight casing as shown in FIG. 10 of this application. In Japanese Unexamined Patent Application Publication No. 2009-110754, a waterproof material 101, such as silicone rubber, nitrile rubber, or chloroprene rubber, is poured into the electric connector 100 so as to prevent any defective connection due to dew condensation.

However, the structure disclosed in Japanese Unexamined Patent Application Publication No. 2009-110754 requires a waterproof material, which results in an increase in the weight of the electric connector 100 equivalent to the amount of the material. Further, the structure requires the process of pouring and solidifying the material. Therefore, there is a room for reducing the cost of this structure.

It is an object of the present invention to provide a technique to achieve countermeasures against a defective connection due to dew condensation at a low cost.

SUMMARY OF THE INVENTION

An exemplary aspect of the present invention is a connector that is attached to a casing and allows an electric wire within the casing to be attached to the connector. The connector includes a housing. The housing includes a rectangular tubular portion that projects toward an inside of the casing in a rectangular tubular shape and covers the electric wire within the casing. The rectangular tubular portion has four outer surfaces. The four outer surfaces are respectively provided with drain grooves in such a manner that the drain grooves are continuous with each other, the drain grooves being made of a metal formed by casting, or being made of a resin formed by injection molding. A cross-section of each of the drain grooves has an asymmetrical shape in which a deepest portion of each of the drain grooves is farther from a tip of the rectangular tubular portion than a center of a groove width of each of the drain grooves. The deepest portion of each of the drain grooves is raised at a center of each of the drain grooves in a longitudinal direction so that a water droplet within the drain grooves moves toward ends of each of the drain grooves in the longitudinal direction.

According to the present invention, countermeasures against a defective connection due to dew condensation can be achieved at a low cost.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Figure 1:
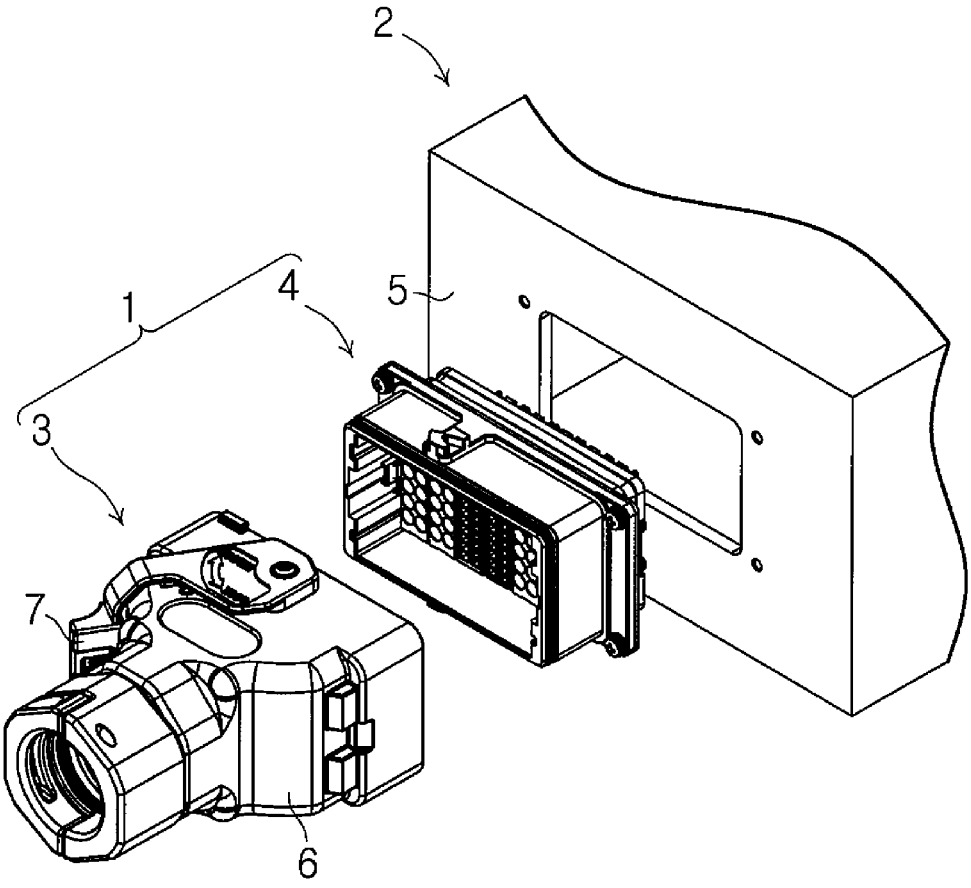
FIG. 1 is a perspective view showing a state of a lever connector assembly before mating.

A lever connector assembly 1 will be described below with reference to FIGS. 1 to 9. FIG. 1 shows a state before mating of the lever connector assembly 1. As shown in FIG. 1, the lever connector assembly 1 according to an exemplary embodiment is used as, for example, an interface of an airtight casing 2, such as industrial equipment. The lever connector assembly 1 includes the plug 3 and the receptacle 4 (connector).

The casing 2 includes a front panel 5 (plate). The thickness direction of the front panel 5 is horizontal in this exemplary embodiment.

The plug 3 is attached to an end of an electric wire bundle that is a bundle of a plurality of electric wires used for power supply and signal communication. The plug 3 includes a plug shell 6 made of a metal, a lever 7, a plurality of plug contacts, and a plurality of plug insulating support bodies. Each of the plug insulating support bodies holds the plurality of plug contacts. The plug shell 6 holds the plurality of plug insulating support bodies. The lever 7 is rotatably attached to the plug shell 6. The lever 7 is a booster mechanism that generates a mating force necessary for mating the plug 3 and the receptacle 4 together.

Figure 2:
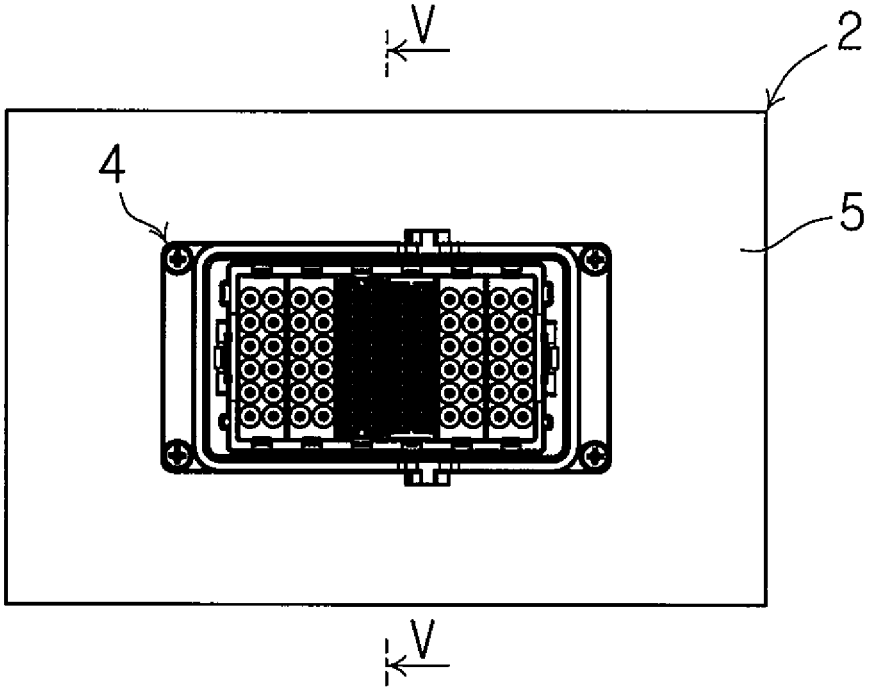
FIG. 2 is an elevation view showing a receptacle attached to a front panel of a casing.
Figure 3:
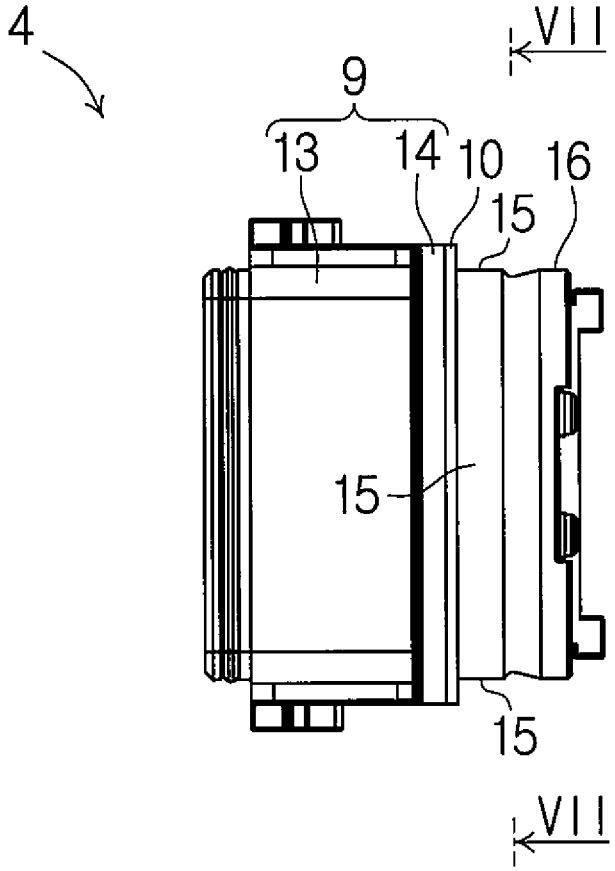
FIG. 3 is a side view of the receptacle.
Figure 4:
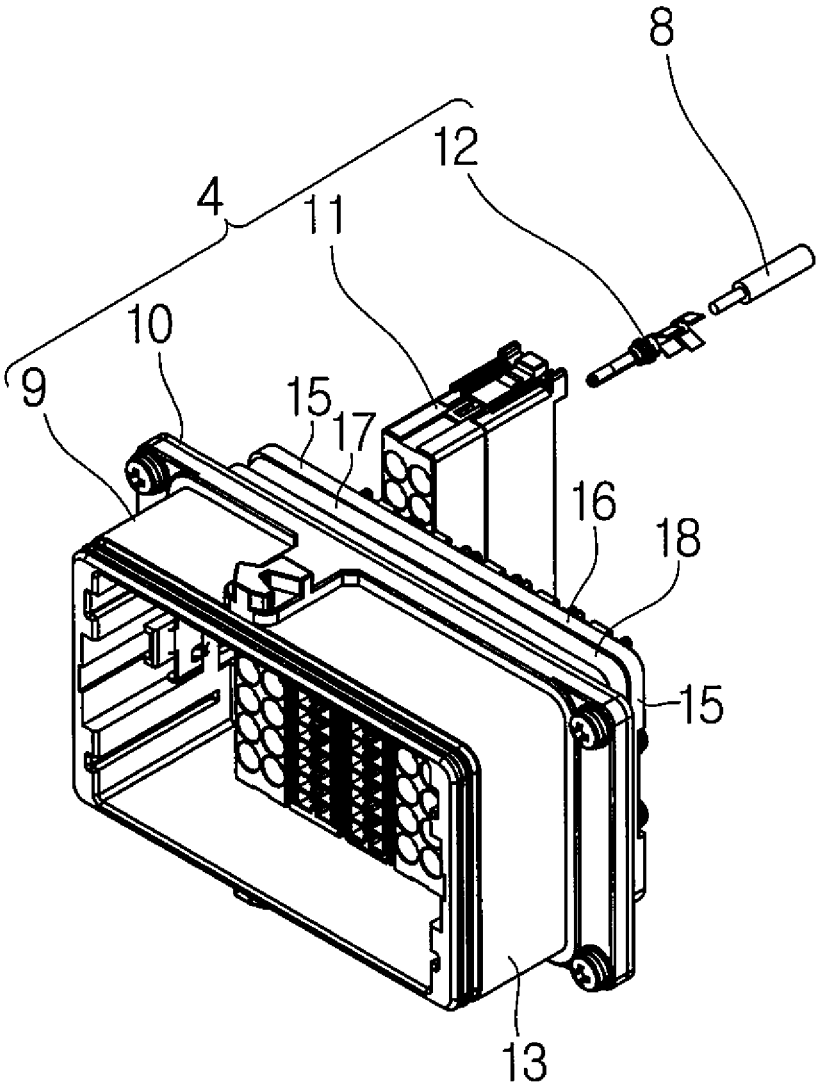
FIG. 4 is an exploded perspective view of the receptacle.
Figure 5:
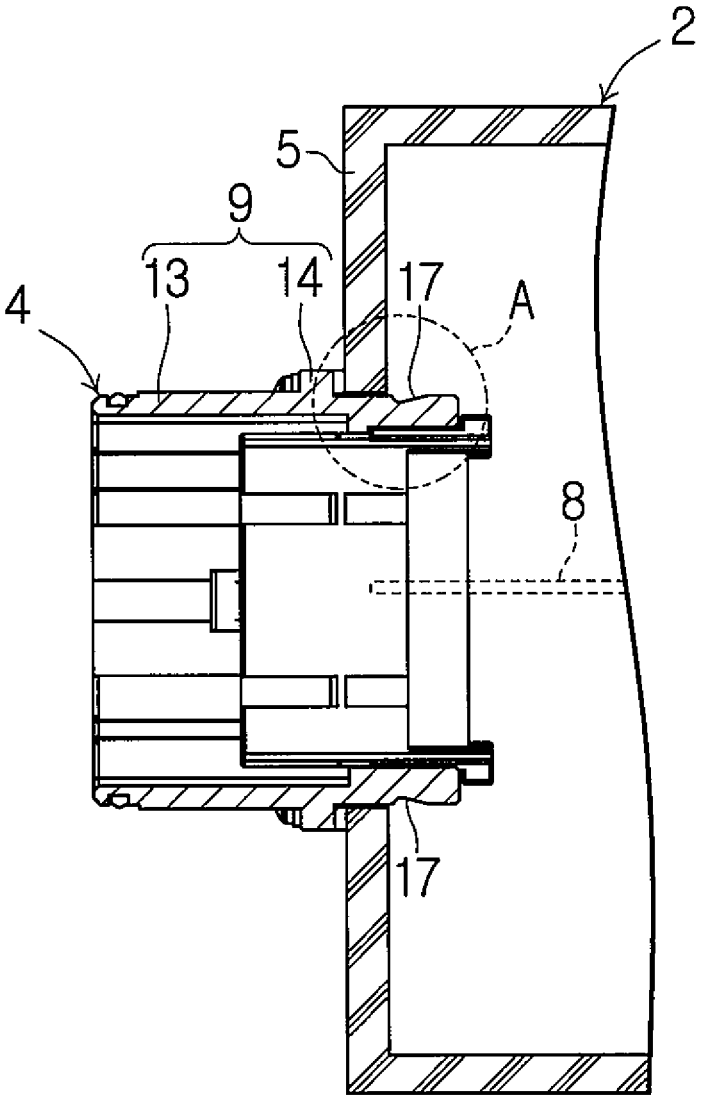
FIG. 5 is a sectional view taken along a line V-V of FIG. 2.

FIG. 2 is an elevation view showing the receptacle 4 that is attached to the front panel 5 of the casing 2. FIG. 3 is a side view of the receptacle 4. FIG. 4 is an exploded perspective view of the receptacle 4. FIG. 5 is a sectional view taken along a line V-V of FIG. 2.

As shown in FIGS. 4 and 5, the receptacle 4 is a connector that is attached to the front panel 5 of the casing 2 and allows electric wires 8 within the casing 2 to be attached to the receptacle 4. As shown in FIG. 4, the receptacle 4 includes a receptacle shell 9 (housing) made of a metal, a waterproof seal 10, a plurality of receptacle insulating support bodies 11, and a plurality of receptacle contacts 12.

In this exemplary embodiment, the receptacle shell 9 is made of a metal, such as an aluminum alloy, which is formed by casting. Alternatively, the receptacle shell 9 may be made of a resin, such as an ABS resin, which is formed by injection molding. As shown in FIG. 5, the receptacle shell 9 includes a rectangular tubular portion 13 and a flange 14. The rectangular tubular portion 13 is a portion extending in a rectangular tubular shape along the thickness direction of the front panel 5 of the casing 2. The flange 14 is used to attach the rectangular tubular portion 13 to the front panel 5 of the casing 2, and is formed substantially at the center of the rectangular tubular portion 13 in the mating direction. In a state where the receptacle 4 is attached to the front panel 5 of the casing 2, the rectangular tubular portion 13 projects toward the inside of the casing 2 and covers the electric wires 8 within the casing 2. As shown in FIGS. 3 and 4, the rectangular tubular portion 13 has four outer surfaces 15. An outer periphery 16 of the rectangular tubular portion 13 is formed of the four outer surfaces 15. The rectangular tubular portion 13 will be described in detail later.

Figure 6:
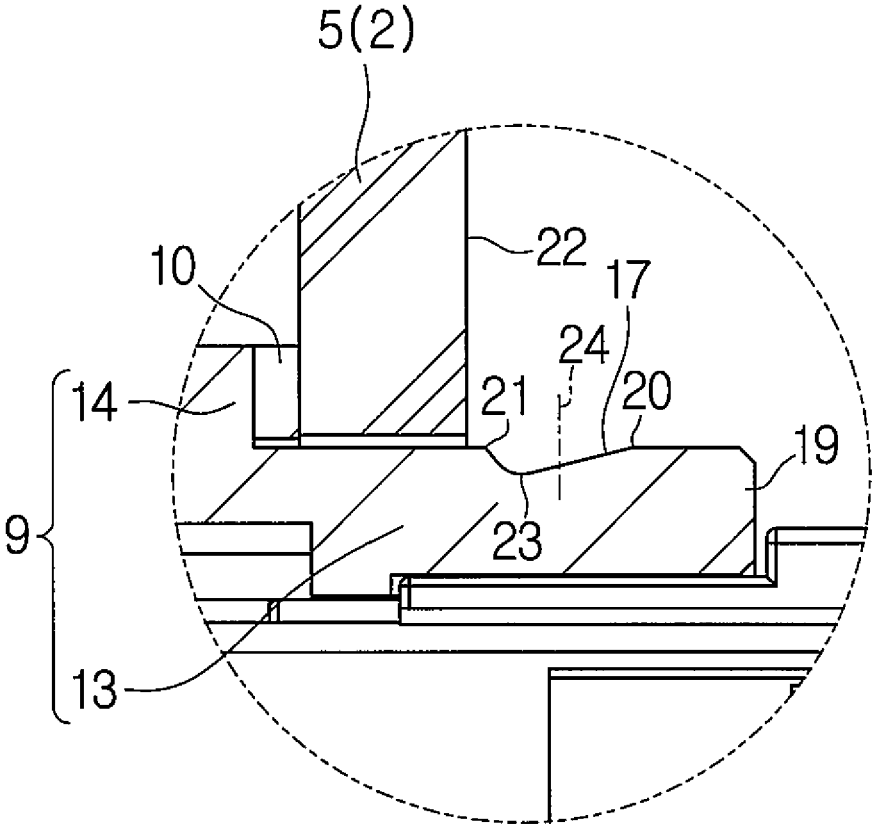
FIG. 6 is an enlarged view showing a portion "A" shown in FIG. 5.

As shown in FIG. 6, the waterproof seal 10 is disposed between the front panel 5 of the casing 2 and the flange 14.

As shown in FIG. 4, each receptacle contact 12 is attached to an end of the corresponding electric wire 8 within the casing 2.

Each of the receptacle insulating support bodies 11 holds the plurality of receptacle contacts 12. The plurality of receptacle insulating support bodies 11 are accommodated in the rectangular tubular portion 13 of the receptacle shell 9.

Figure 7:
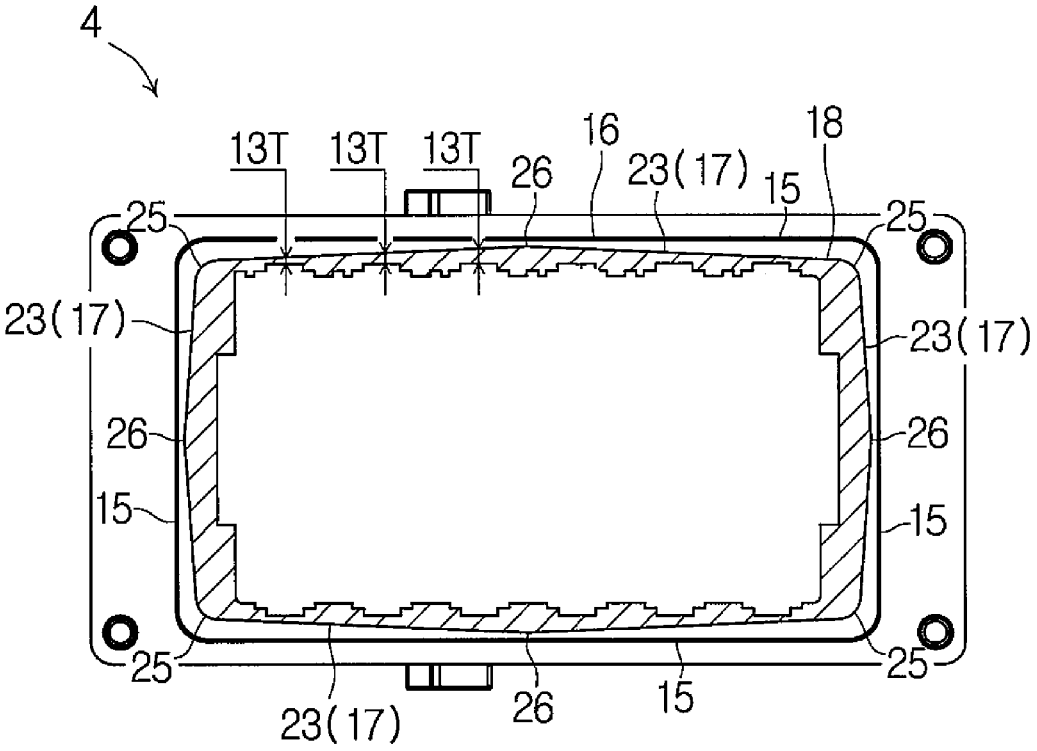
FIG. 7 is a sectional view taken along a line VII-VII of FIG. 3.
Figure 8:
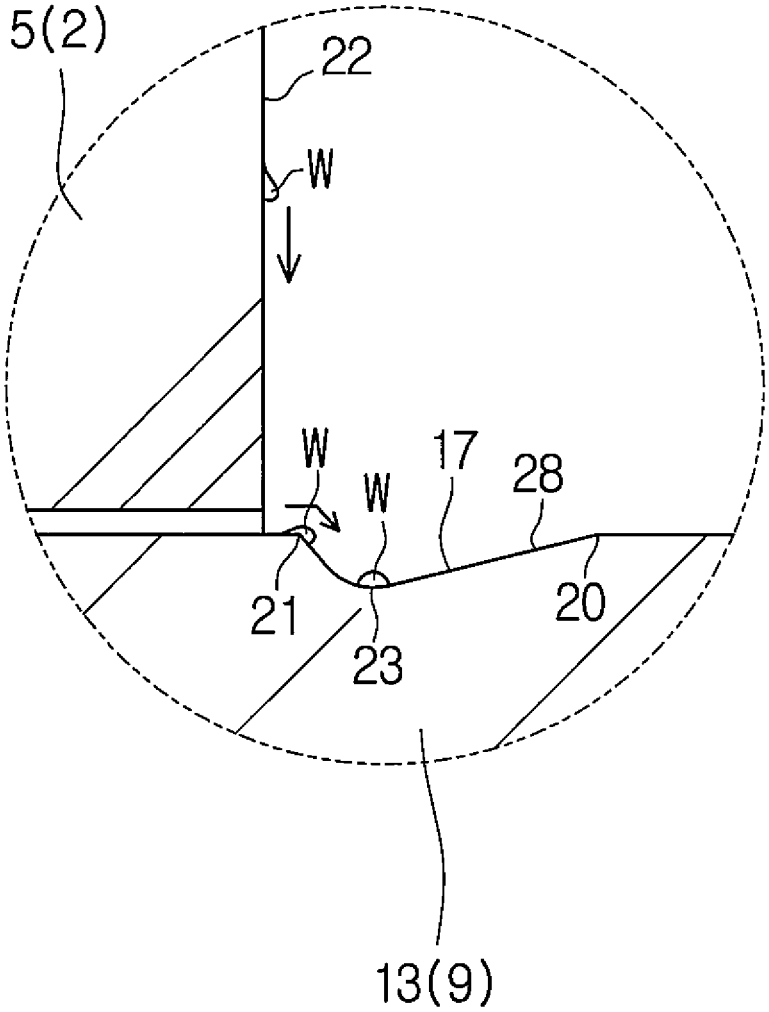
FIG. 8 is a diagram showing a state where a water droplet generated on an inner surface of the front panel of the casing is trapped in a drain groove.
Figure 9:
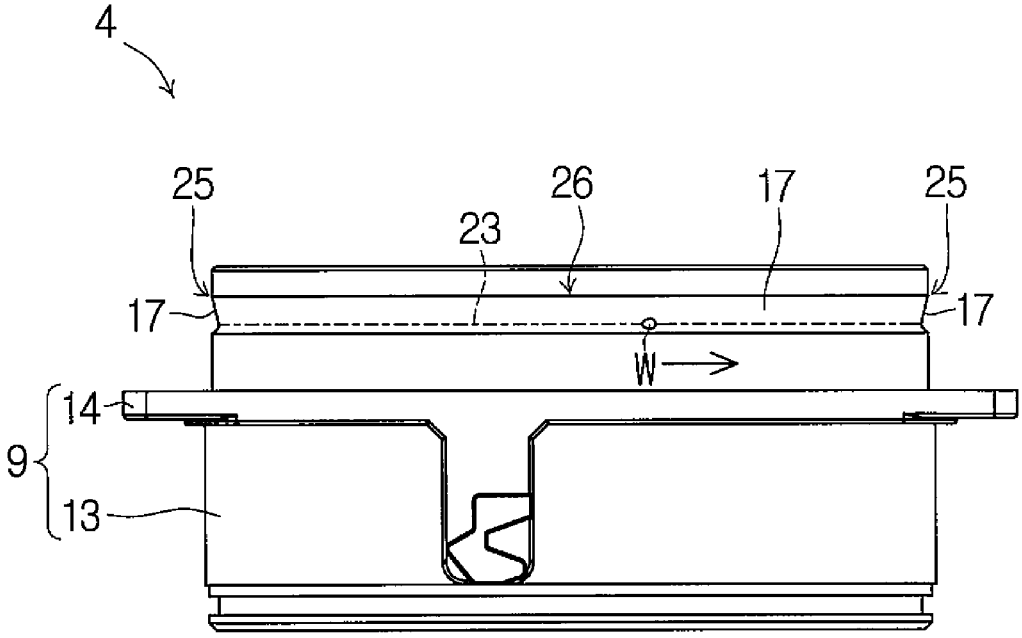
FIG. 9 is a plan view of the receptacle.

Referring next to FIGS. 4 to 9, the rectangular tubular portion 13 of the receptacle shell 9 will be described in detail. FIG. 7 is a sectional view taken along a line VII-VII of FIG. 3. FIG. 8 shows a state where a water droplet W generated on an inner surface 22 of the front panel 5 of the casing 2 is accommodated in one of drain grooves 17. FIG. 9 is a plan view of the receptacle 4.

As shown in FIGS. 4 to 7, the drain grooves 17 each extending along the front panel 5 of the casing 2 are respectively formed in the four outer surfaces 15 of the rectangular tubular portion 13. As shown in FIGS. 4 and 7, the four drain grooves 17 are formed to be continuous with each other. Specifically, the drain grooves 17 are formed in such a manner that one drain groove 17 is continuous with another drain groove 17 formed in the outer surface 15 adjacent to the outer surface 15 in which the one drain groove 17 is formed. Thus, a seamless annular drain groove 18 is formed on the outer periphery 16 of the rectangular tubular portion 13. In other words, the annular drain groove 18 formed of the four drain grooves 17 is formed on the entire outer periphery 16 of the rectangular tubular portion 13.

As shown in FIG. 6, each drain groove 17 is formed so as to be located within the casing 2 in a state where the receptacle 4 is attached to the front panel 5 of the casing 2. In other words, each drain groove 17 is disposed at a location closer to a tip 19 of the rectangular tubular portion 13 than the front panel 5 of the casing 2. The tip 19 of the rectangular tubular portion 13 is an end of the rectangular tubular portion 13 that is located within the casing 2. Each drain groove 17 is located between the inner surface 22 of the front panel 5 of the casing 2 and the tip 19 of the rectangular tubular portion 13. Each drain groove 17 has a front edge 20 that is close to the tip 19 of the rectangular tubular portion 13, and a rear edge 21 that is close to the flange 14. Each drain groove 17 includes the front edge 20 and the rear edge 21. The front edge 20 is an edge of the drain groove 17 and is located near the tip 19 of the rectangular tubular portion 13. The rear edge 21 is an edge of the drain groove 17 and is located near the inner surface 22 of the front panel 5 of the casing 2. The front edge 20 and the rear edge 21 of each drain groove 17 are closer to the tip 19 of the rectangular tubular portion 13 than the inner surface 22 of the front panel 5 of the casing 2.

The cross-section of each drain groove 17 has an asymmetrical V-shape and is smooth and shallow. Each drain groove 17 has a depth that gradually increases toward the front panel 5 of the casing 2. Specifically, the cross-section of each drain groove 17 has an asymmetrical shape in which a deepest portion 23 of the drain groove 17 is farther from the tip 19 of the rectangular tubular portion 13 than a groove width center 24 of the drain groove 17. The deepest portion 23 of each drain groove 17 is formed in a curved surface shape.

As shown in FIG. 7, the deepest portion 23 of each drain groove 17 is raised at a center 26 of the drain groove 17 in the longitudinal direction in such a manner that a water droplet W within the drain groove 17 moves toward both ends 25 of the drain groove 17 in the longitudinal direction. That is, the deepest portion 23 of each drain groove 17 is inclined in a V-shape toward the both ends 25 from the center 26 of the drain groove 17. In other words, the deepest portion 23 of each drain groove 17 is inclined in a V-shape so as to be convex at the center 26 of the drain groove 17.

A thickness 13T of the rectangular tubular portion 13 at the deepest portion 23 of each drain groove 17 is set in such a manner that the thickness 13T is largest at the center 26 of the drain groove 17 in the longitudinal direction and decreases toward the both ends 25 of the drain groove 17 in the longitudinal direction. The above structure contributes to miniaturization of the receptacle 4, as compared to, for example, a case where the deepest portion 23 of each drain groove 17 is inclined in the longitudinal direction of each drain groove 17 and the thickness 13T of the rectangular tubular portion 13 at the deepest portion 23 of the drain groove 17 is constant.

As shown in FIG. 8, there is a case where a water droplet W is generated due to dew condensation on the inner surface 22 of the front panel 5 of the airtight casing 2. If this water droplet W enters the rectangular tubular portion 13 and the electric wires 8 get wet, a defective connection, such as short-circuiting, may be caused. On the other hand, in this exemplary embodiment, the drain grooves 17 formed in the rectangular tubular portion 13 as described above provide a drainage effect as described below.

That is, as shown in FIG. 8, assume that a water droplet W is generated due to dew condensation on the inner surface 22 of the front panel 5 of the casing 2 at a location above the rectangular tubular portion 13. The water droplet W flows downward by gravity and is trapped in the drain groove 17 across the rear edge 21 of the drain groove 17. The water droplet W trapped in the drain groove 17 is positioned at the deepest portion 23 of the drain groove 17 based on the principle of energy minimization. As shown in FIG. 9, the water droplet W flows downward toward one of the ends 25 of the drain groove 17 along the deepest portion 23 of the drain groove 17 due to the inclination of the deepest portion 23 of the drain groove 17. After that, the water droplet W is transferred to the adjacent drain groove 17. The water droplet W transferred to the adjacent drain groove 17 flows downward along the drain groove 17 by their own weight, and drops downward from the rectangular tubular portion 13.

The drain grooves 17 shown in FIG. 8 are formed at the same time during casting. Accordingly, an inner surface 28 of each drain groove 17 has surface characteristics specific to casting. That is, the inner surface 28 of each drain groove 17 is a casting surface. Since the inner surface 28 of each drain groove 17 is a casting surface, the water droplet W within the drain grooves 17 can be more easily transferred than in a case where the inner surface 28 of each drain groove 17 has surface characteristics specific to cutting (imprints due to cutting). The exemplary embodiment of the present invention described above has the following features.

(1) As shown in FIGS. 1 to 9, the receptacle 4 (connector) is a connector that is attached to the casing 2 and allows the electric wires 8 within the casing 2 to be attached to the receptacle 4. The receptacle 4 includes the receptacle shell 9 (housing). The receptacle shell 9 includes the rectangular tubular portion 13 that projects toward the inside of the casing 2 and covers the electric wires 8 within the casing 2. The rectangular tubular portion 13 has the four outer surfaces 15. The four outer surfaces 15 are respectively provided with drain grooves 17 which are made of a metal formed by casting and which are continuous with each other. The cross-section of each of the drain grooves 17 has an asymmetrical shape in which the deepest portion 23 of each of the drain grooves 17 is farther from the tip 19 of the rectangular tubular portion 13 than the groove width center 24 of the drain groove 17. The deepest portion 23 of each of the drain grooves 17 is raised at the center 26 of the drain groove 17 in the longitudinal direction so that a water droplet W within each drain groove 17 moves toward the ends 25 of the drain groove 17 in the longitudinal direction.

According to the above structure, countermeasures against a defective connection due to dew condensation can be achieved at a low cost for the following reasons (A) and (B).

Figure 10:
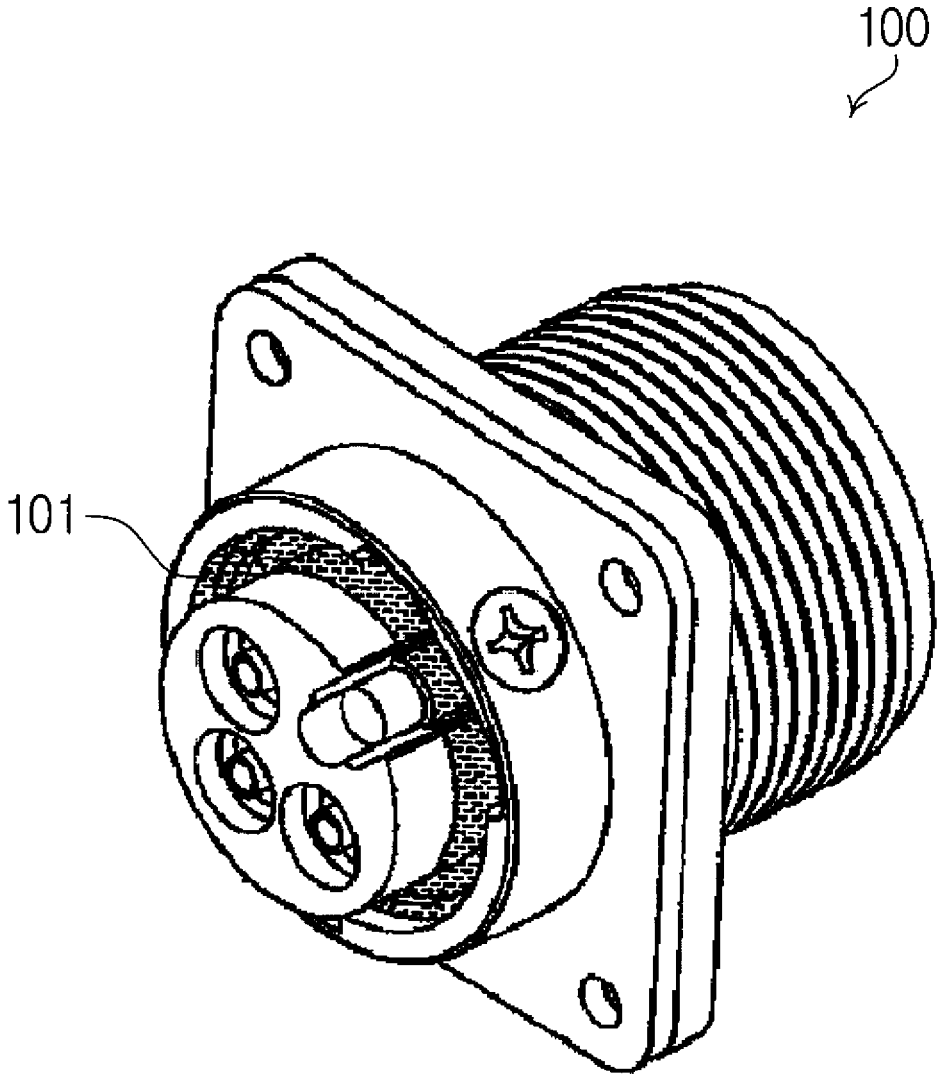
FIG. 10 is a diagram corresponding to FIG. 1 of Japanese Unexamined Patent Application Publication No. 2009-110754.

(A) As shown in FIG. 10, in Japanese Unexamined Patent Application Publication No. 2009-110754, in order to prevent any defective connection from occurring due to dew condensation, the waterproof material 101, such as silicone rubber, nitrile rubber, or chloroprene rubber, is poured into the electric connector 100. On the other hand, in this exemplary embodiment, instead of pouring the waterproof material 101 into the electric connector 100, the drain grooves 17 are formed in the rectangular tubular portion 13 of the receptacle shell 9 so that the drain grooves 17 enable a water droplet W generated due to dew condensation to be seamlessly guided from the top of the rectangular tubular portion 13 to the bottom thereof, thereby preventing the water droplet W from reaching the electric wires 8 within the rectangular tubular portion 13. This eliminates the need for the waterproof material 101, such as silicone rubber, nitrile rubber, or chloroprene rubber, and also eliminates the need for the process of pouring and solidifying the waterproof material 101 such as silicone rubber, nitrile rubber, or chloroprene rubber. For this reason, countermeasures against a defective connection due to dew condensation can be achieved at a low cost.

(B) In this exemplary embodiment, the drain grooves 17 are formed by casting. Accordingly, the cost of forming each drain groove 17 is much lower than that in the case where each drain groove 17 is formed by cutting. This contributes to a reduction in cost of countermeasures against a defective connection due to dew condensation.

The above structure also contributes to reducing the weight of the receptacle 4 for the following reason (C).

(C) As shown in FIG. 10, in Japanese Unexamined Patent Application Publication No. 2009-110754, in order to prevent any defective connection from occurring due to dew condensation, the waterproof material 101, such as silicone rubber, nitrile rubber, or chloroprene rubber, is poured into the electric connector 100. On the other hand, in this exemplary embodiment, instead of pouring the waterproof material 101 into the electric connector 100, the drain grooves 17 are formed in the rectangular tubular portion 13 of the receptacle shell 9 so that the drain grooves 17 enable a water droplet W generated due to dew condensation to be seamlessly guided from the top of the rectangular tubular portion 13 to the bottom thereof, thereby preventing the water droplet W from reaching the electric wires 8 within the rectangular tubular portion 13. This eliminates the need for the waterproof material 101, such as silicone rubber, nitrile rubber, or chloroprene rubber. Therefore, the above structure contributes to weight saving of the receptacle 4. According to the above structure, an extremely high drainage effect can be obtained for the following reasons (D) to (I).

(D) That is, the drain grooves 17 are respectively formed in all the outer surfaces 15 of the rectangular tubular portion 13. Accordingly, regardless of mounting direction of the receptacle 4, the drainage effect of the drain grooves 17 can be obtained without any problem. The structure in which the mounting direction of the receptacle 4 is not limited is extremely useful in the field of connectors.

(E) The cross-section of each drain groove 17 has an asymmetrical shape in which the deepest portion 23 of each drain groove 17 is farther from the tip 19 of the rectangular tubular portion 13 than the groove width center 24 of the drain groove 17. Accordingly, unlike in a case where the cross-section of each drain groove 17 has a symmetrical shape, a water droplet W is actually kept away from the tip 19 of the rectangular tubular portion 13. Therefore, it is less likely that the water droplet W goes over the tip 19 of the rectangular tubular portion 13 and enters the rectangular tubular portion 13. Consequently, an extremely high drainage effect can be obtained.

(F) The deepest portion 23 of each drain groove 17 is raised at the center 26 of the drain groove 17 in the longitudinal direction so that a water droplet W within each drain groove 17 moves toward the ends 25 of the drain groove 17 in the longitudinal direction. According to the above structure, the water droplet W within each drain groove 17 can reach the ends 25 of each drain groove 17 by a shortest distance. Therefore, an extremely high drainage effect can be obtained. Further, since the above-mentioned raised portion is formed in all the four drain grooves 17, an extremely high drainage effect can be obtained, regardless of the mounting direction of the receptacle 4 to the front panel 5 of the casing 2.

(G) As a synergetic effect of the above-mentioned reasons (E) and (F), the movement of the water droplet W generated for the above-mentioned reason (F) occurs at a location far from the tip 19 of the rectangular tubular portion 13 for the above-mentioned reason (E). Accordingly, the water droplet W is rapidly drained at a location far from the tip 19 of the rectangular tubular portion 13, which is extremely advantageous as a countermeasure against a defective connection.

(H) Each drain groove 17 is made of a metal formed by casting. In other words, the inner surface 28 of each drain groove 17 has surface characteristics (casting surface) specific to casting. Accordingly, a water droplet W within each drain groove 17 can be more easily transferred within each drain groove 17 than in a case where the inner surface 28 of each drain groove 17 has surface characteristics specific to cutting (imprints due to cutting). Therefore, an extremely high drainage effect can be obtained.

(I) The four drain grooves 17 are formed to be continuous with each other. According to this structure, a water droplet W can be transferred between the adjacent drain grooves 17 without any problem, regardless of the mounting direction of the receptacle 4 to the front panel 5 of the casing 2.

Each drain groove 17 is closer to the tip 19 of the rectangular tubular portion 13 than the front panel 5 of the casing 2. According to this structure, the drainage effect of the drain grooves 17 can be obtained without any problem.

The drain grooves 17 may be formed in such a manner that the drain grooves 17 partially overlap the front panel 5 of the casing 2, as long as a water droplet W generated on the inner surface 22 of the front panel 5 of the casing 2 can be trapped within the drain groove 17.

(2) The deepest portion 23 of each drain groove 17 is formed in a curved surface shape. According to this structure, a water droplet W within each drain groove 17 can be more easily transferred within each drain groove 17 than in a case where each drain groove 17 has a sharp angle. Therefore, an extremely high drainage effect can be obtained.

The preferred exemplary embodiment of the present invention described above can be modified as follows.

That is, in the above exemplary embodiment, the receptacle 4 is attached to the front panel 5 with screws from the outside of the casing 2. Alternatively, the receptacle 4 may be attached to the front panel 5 from the inside of the casing 2.

Instead of using the receptacle shell 9 made of a metal, the receptacle shell 9 made of a resin formed by injection molding may be used. In other words, each drain groove 17 may be made of a resin formed by injection molding. Also in this case, the drain grooves 17 are preferably formed at the same time during injection molding for the same reason as described above, instead of forming the drain grooves 17 by cutting. In this case, the inner surface 28 of each drain groove 17 has surface characteristics specific to injection molding. The surface characteristics specific to injection molding indicate a casting surface.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A connector that is attached to a casing and allows an electric wire within the casing to be attached to the connector, the connector comprising a housing, wherein the housing includes a rectangular tubular portion that projects toward an inside of the casing in a rectangular tubular shape and covers the electric wire within the casing, the rectangular tubular portion has four outer surfaces, the four outer surfaces are respectively provided with drain grooves in such a manner that the drain grooves are continuous with each other, the drain grooves being made of a metal formed by casting, or being made of a resin formed by injection molding, a cross-section of each of the drain grooves has an asymmetrical shape in which a deepest portion of each of the drain grooves is farther from a tip of the rectangular tubular portion than a center of a groove width of each of the drain grooves, the deepest portion of each of the drain grooves is raised at a center of each of the drain grooves in a longitudinal direction so that a water droplet within the drain grooves moves toward ends of each of the drain grooves in the longitudinal direction, the connector is configured to be attached to a panel of the casing, and each drain groove is configured to be located between an inner surface of the panel of the casing and the tip of the rectangular tubular portion.

2. The connector according to claim 1, wherein the deepest portion of each of the drain grooves is formed in a curved surface shape.

3. A connector that is attached to a casing and allows an electric wire within the casing to be attached to the connector, the connector comprising a housing, wherein the housing includes a rectangular tubular portion that projects toward an inside of the casing in a rectangular tubular shape and covers the electric wire within the casing, the rectangular tubular portion has four outer surfaces, the four outer surfaces are respectively provided with drain grooves in such a manner that the drain grooves are continuous with each other, the drain grooves being made of a metal formed by casting, or being made of a resin formed by injection molding, a cross-section of each of the drain grooves has an asymmetrical shape in which a deepest portion of each of the drain grooves is farther from a tip of the rectangular tubular portion than a center of a groove width of each of the drain grooves, the deepest portion of each of the drain grooves is raised at a center of each of the drain grooves in a longitudinal direction so that a water droplet within the drain grooves moves toward ends of each of the drain grooves in the longitudinal direction, the connector is configured to be attached to a panel of the casing, each drain groove includes a front edge and a rear edge, the front edge being located nearer to the tip of the rectangular tubular portion than the rear edge, and the front edge and the rear edge of each drain groove are configured to be located between an inner surface of the panel of the casing and the tip of the rectangular tubular portion.

4. The connector according to claim 3, wherein the deepest portion of each of the drain grooves is formed in a curved surface shape.

* * * * *